US005904256A

United States Patent [19]

Jay

[11] Patent Number: 5,904,256

[45] Date of Patent: May 18, 1999

[54] OFFSET LOCKING DEVICE FOR DISPLAY CHANNELS

[75] Inventor: Richard Jay, Westport, Conn.

[73] Assignee: Display Technologies, Inc., Whitestone, N.Y.

[21] Appl. No.: 09/023,509

[22] Filed: Feb. 13, 1998

[51] Int. Cl.[6] ..... A47F 5/00

[52] U.S. Cl. ..... 211/59.2; 211/74; 211/175; 312/42

[58] Field of Search ..... 211/59.2, 59.3, 211/74, 184, 175; 312/42, 45

[56] References Cited

U.S. PATENT DOCUMENTS

| | | | |
|---|---|---|---|
| 4,785,945 | 11/1988 | Rowse et al. | 312/42 X |
| 5,240,126 | 8/1993 | Foster et al. | 211/175 X |
| 5,562,217 | 10/1996 | Salveson et al. | 211/175 X |
| 5,624,042 | 4/1997 | Flum et al. | 312/42 X |
| 5,634,564 | 6/1997 | Spamer et al. | 211/175 X |
| 5,645,176 | 7/1997 | Jay | 211/59.2 |
| 5,806,690 | 9/1998 | Johnson et al. | 211/184 X |

*Primary Examiner*—Robert W. Gibson, Jr.
*Attorney, Agent, or Firm*—Amster, Rothstein & Ebenstein

[57] ABSTRACT

The display rack includes a plurality of separate and distinct longitudinally elongate channels. Each channel has a front, a track and a pair of laterally spaced, longitudinally extending sides. Additionally, each channel has on one side thereof a plurality of widely longitudinally spaced apart male engaging means (lugs) projecting laterally outwardly from the channel side; and, for each one of the male engaging means, the other channel side has an associated set of at least three relatively narrowly longitudinally spaced apart female engaging means (slots). The associated slot sets are widely longitudinally spaced apart, and each female engaging means of the associated slot sets is configured and dimensioned to receive one of the male engaging means. The male and female engaging means are configured and dimensioned to releasably retain an adjacent pair of the channels in a side-by-side, longitudinally parallel relationship in a common horizontal plane, with the fronts of the adjacent pair of channels in horizontal alignment or horizontal non-alignment depending on which female engaging means of the associated sets the male engaging means are disposed in.

8 Claims, 4 Drawing Sheets

FIG. 4
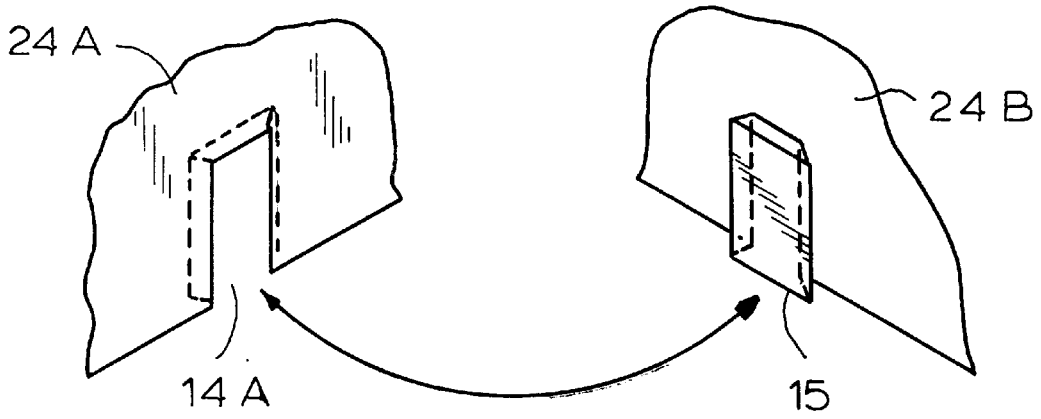
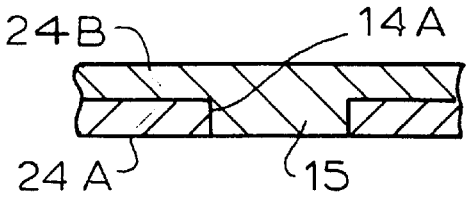
FIG. 6
FIG. 5
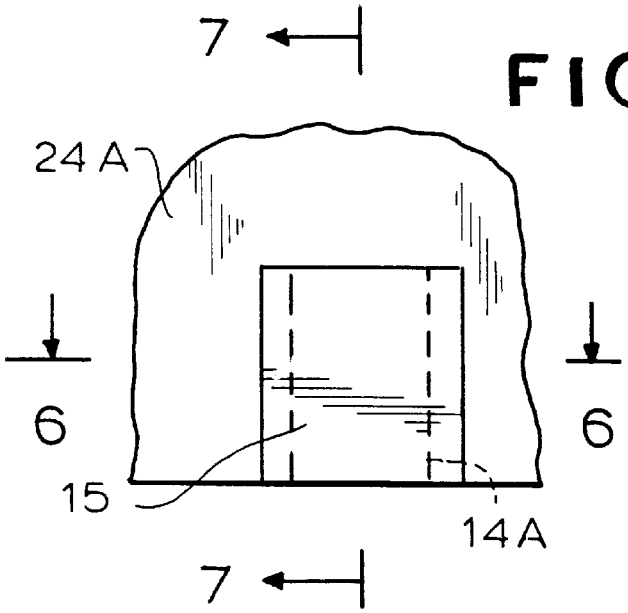
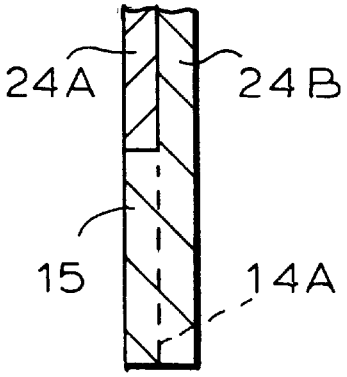
FIG. 7

OFFSET LOCKING DEVICE FOR DISPLAY CHANNELS

BACKGROUND OF THE INVENTION

The present invention relates to display channels which may be assembled together in a longitudinally parallel, side-by-side relationship in a common horizontal plane by a retailer to form a display rack, and more particularly to such a display rack having an unusual configuration.

It is well known to form a display rack by securing together two or more separate and distinct, longitudinally elongate channels disposed side-by-side in a common horizontal plane, thereby to form a display rack having a plurality of channels. U.S. Pat. No. 5,645,176, issued Jul. 8, 1997, is incorporated herein by reference as fully as if set forth herein. Typical securing means include a plurality of widely longitudinally spaced apart sets of male engaging means projecting laterally outwardly from one of the channel sides and a like plurality of widely longitudinally spaced apart sets of female engaging means defined by the other of the channel sides (for example, the other side of the adjacent channel). Each widely spaced apart set of male engaging means (including a front set and a rear set) typically includes at least three relatively narrowly longitudinally spaced apart male engaging means, and each widely spaced apart set of female engaging means (including a front set and a rear set) typically includes a like number of relatively narrowly longitudinally spaced apart female engaging means. Thus, each set of male engaging means on one channel cooperates with an associated set of female engaging means on an adjacent channel to hold the two adjacent channels in a predetermined transversely aligned relationship. In other words, when the three lugs of each male engaging means set are received in the three slots of each female engaging means sets of an adjacent channel, the adjacent channels are transversely aligned—i.e., the fronts and backs of the channels are typically horizontally transversely aligned. The male engaging means are typically lugs which serve as keys, while the female engaging means are typically slots which serve as keyways.

Preferably the sets on each channel side are widely spaced apart in the longitudinal direction so that the engagement between the adjacent channels occurs adjacent to the front end thereof and adjacent to the rear end thereof (although the rear set is typically forward of any breakaway or removable portion of a channel.) So, for example, where the channel length is about 24 inches and the breakaway back portions occupy about 7 inches longitudinally, the center-to-center longitudinal spacing between the two sets may be 6 inches. By way of comparison, the center-to-center longitudinal spacing of the male or female engaging means of a given set may be only 0.75 inch.

The known display racks are functionally acceptable for use on store shelves and on support trays having a front defining a straight (i.e., linear) line. However, where the store shelves or support trays present a non-linear front (for example, a curvilinear front), all of the joined channels must still be disposed with their channel fronts defining a straight line intersecting the bottoms of the curves of the curvilinear store shelves or support trays. This results in wasted space on the store shelves or tray supports since none of the channels extend forwardly to the forwardmost aspect or front of the curvilinear store shelves or tray supports. Wasted space is a cardinal sin of merchandising.

From an aesthetic point of view, the conventional display rack, wherein the various channels fronts form a straight line, appears to be boring and monolithic—in other words, dull and uninteresting. As retailers are well aware, an interesting display is more likely to be successful in enticing potential customers than a dull and uninteresting display.

According, it is an object of the present invention to provide a display rack formed by adjacent channels having engaging means for releasably retaining an adjacent channel in a side-by-side, longitudinally parallel relationship in a common horizontal plane, with the channels fronts either in horizontal alignment or horizontal nonalignment, as decided by the retailer.

Another object is to provide such a display rack which can utilize more of the available space on store shelves or tray supports having a non-linear (i.e., curvilinear) front.

A further object is to provide such a display rack which can be assembled from separate and distinct channels with the assembled channel fronts defining a curvilinear front formed as either a stepped convex curve or a stepped concave curve.

SUMMARY OF THE INVENTION

It has now been found that the above and related objects of the present invention are obtained in a display rack according to the present invention. The display rack comprises a plurality of separate and distinct longitudinally elongate channels disposed in a longitudinally parallel, side-by-side relationship in a common horizontal plane. Each channel has a front, a track and a pair of laterally spaced, longitudinally extending sides. Additionally, each channel has a plurality of widely longitudinally spaced apart male engaging means projecting laterally outwardly from one of the channel sides; and, for each one of the male engaging means, an associated set of at least three relatively narrowly longitudinally spaced apart female engaging means defined by the other of the channel sides. The associated sets are widely longitudinally spaced apart, and each female engaging means of the associated sets is configured and dimensioned to receive one of the male engaging means. The male and female engaging means are configured and dimensioned to releasably retain an adjacent pair of the channels in a side-by-side, longitudinally parallel relationship in a common horizontal plane, with the fronts of the adjacent pair of channels in horizontal alignment or horizontal nonalignment depending on which female engaging means of the associated sets the male engaging means are disposed in.

In a preferred embodiment, the fronts of the adjacent pair of trays are in horizontal alignment when the male engaging means are disposed in a middle female engaging means of each associated set, and the fronts of the adjacent pair of the channels are in a horizontally stepped non-alignment when the male engaging means are disposed in a respective end female engaging means of each associated set. Preferably, the channel fronts in combination define a stepped convex curve when the male engaging means are disposed in respective rear end female engaging means of each associated set and a stepped concave curve when the male engaging means are disposed in respective front end female engaging means of each associated set.

Preferably, each set of female engaging means has only three narrowly longitudinally spaced apart female engaging means. Each of the male engaging means is a lug, and each of the female engaging means is a slot.

BRIEF DESCRIPTION OF THE DRAWING

The above and related objects, features, and advantages of the present invention will be more fully understood by reference to the following detailed description of the presently preferred, albeit illustrative, embodiments of the present invention when taken in conjunction with the accompanying drawing wherein:

FIG. 4 is a fragmentary exploded view, to a greatly enlarged scale, of the connecting means of two adjacent channels;

FIG. 5 is a fragmentary side elevational view, to a greatly enlarged scale, of the assembly of connecting means;

FIG. 6 is a fragmentary horizontal view, to a greatly enlarged scale and partially in section, taken along the line 6—6 of FIG. 5; and FIG. 7 is a fragmentary vertical elevational view, to a greatly enlarged scale and partially in section, taken along the line 7—7 of FIG. 5.

DETAILED DESCRIPTION OF THE PREFERRED EMBODIMENTS

Figure 1:
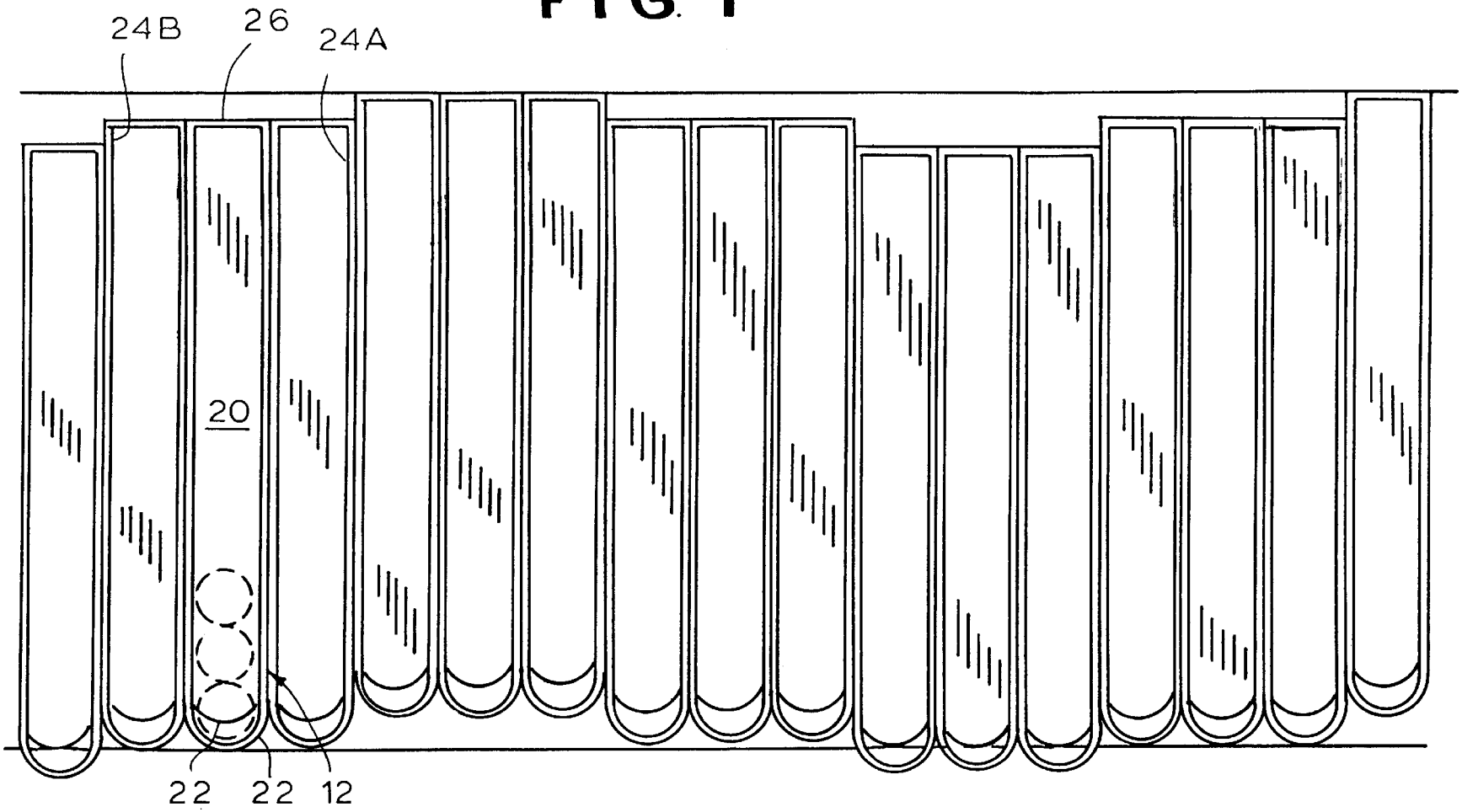
FIG. 1 is a top plan view of a display rack according to the present invention, disposed on a shelf, with the channel fronts thereof forming an undulating pattern.

Referring now to the drawing, and in particular to FIG. 1 thereof, therein illustrated is a display rack according to the present invention, generally designated by the reference numeral 10, disposed on a gravity-feed (i.e., inclined) support such as a store shelf S. The display rack 10 comprises a plurality of separate and distinct longitudinally elongate channels, generally designated 12, Securing means (not seen in FIG. 1) are provided for securing the plurality of separate and distinct channels 12 in a side-by-side, longitudinally parallel and transversely adjacent relationship in a common horizontal plane. The securing system (i.e., the lug 15 and slot 14 system of the present invention) provides a releasable locking system to maintain two adjacent channels in a tight and secure relationship by means of dovetail arrangements. Alternatively a variety of other conventional securing mechanisms may be used to secure the channels 12 in such relationship. A preferred securing means will be described hereinbelow, but it will be recognized that other securing means may be equally as suitable, albeit with its own special advantages and disadvantages.

The typical channel 12 includes a track 20 for supporting the products, a front 22 for limiting the forward motion of the lead product on the track 20 under the influence of gravity, and a pair of laterally spaced, longitudinally extending sides or sidewalls 24, generally upstanding from the track 20, to limit lateral movement of the products off the track 20. Typically a rear or back wall 26 is also provided, but this is not necessary and may be lost if any breakaway rear portions of the channels are removed.

Referring now to FIGS. 2–7, the securing means of the present invention is formed by male engaging means or lugs 15 projecting laterally outwardly from one channel side 24A and female engaging means or bottom-open slots 14 defined by the other channel side 24B (or the other side of an adjacent channel). Each slot 14 is configured and dimensioned such that it can receive a lug 15 passing upwardly through the open bottom end of the slot 14, as identified by the double-headed arrow of FIG. 4, and releasably maintain the enlarged head of the lug 15 against withdrawal through the slot 14 until there is a vertical displacement of the channels (that is, of the lug 15 and the slot 14).

Figure 2:
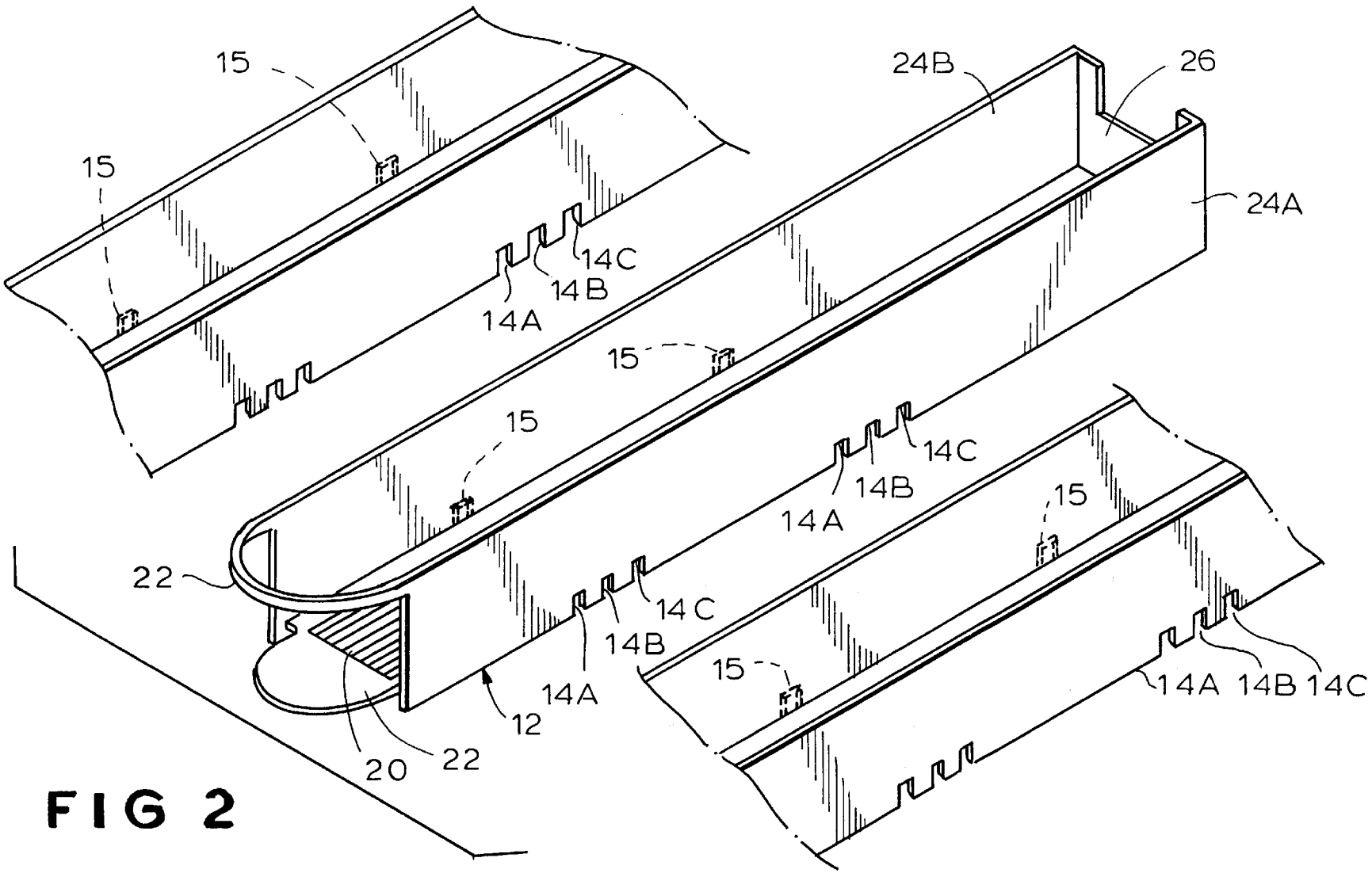
FIG. 2 is a fragmentary exploded isometric view of A display rack formed of three channels.

A plurality of the widely longitudinally spaced apart lugs 15 (three being shown) are disposed on the channel side 24A, as best seen in FIG. 2. For each one of the lugs 15, there is an associated set, generally designated 30, of at least three relatively narrowly longitudinally spaced apart slots 14 defined by the opposite channel side 24B. Preferably, the number of slot sets 30 equals or exceeds the number of lugs 15. As illustrated, each slot set 30 is composed of only three slots 14—namely, the slots 14A, 14B and 14C. The associated sets 30 are widely longitudinally spaced apart on the channel side 24B, and each of the three slots 14 thereof is configured and dimensioned to receive one of the lugs 15 to form a dovetail or like releasable connection. As will be apparent to those skilled in the art, the lugs 15 and slots 14 are configured and dimensioned to releasably retain adjacent pairs of the channels 12 in a side-by-side, longitudinally parallel relationship in a common horizontal plane. The fronts of the channel pair are either in horizontal (i.e., transverse) alignment or non-alignment, depending on which slots 14 of the associated slot sets 30 the lugs 15 are disposed in.

Figure 3:
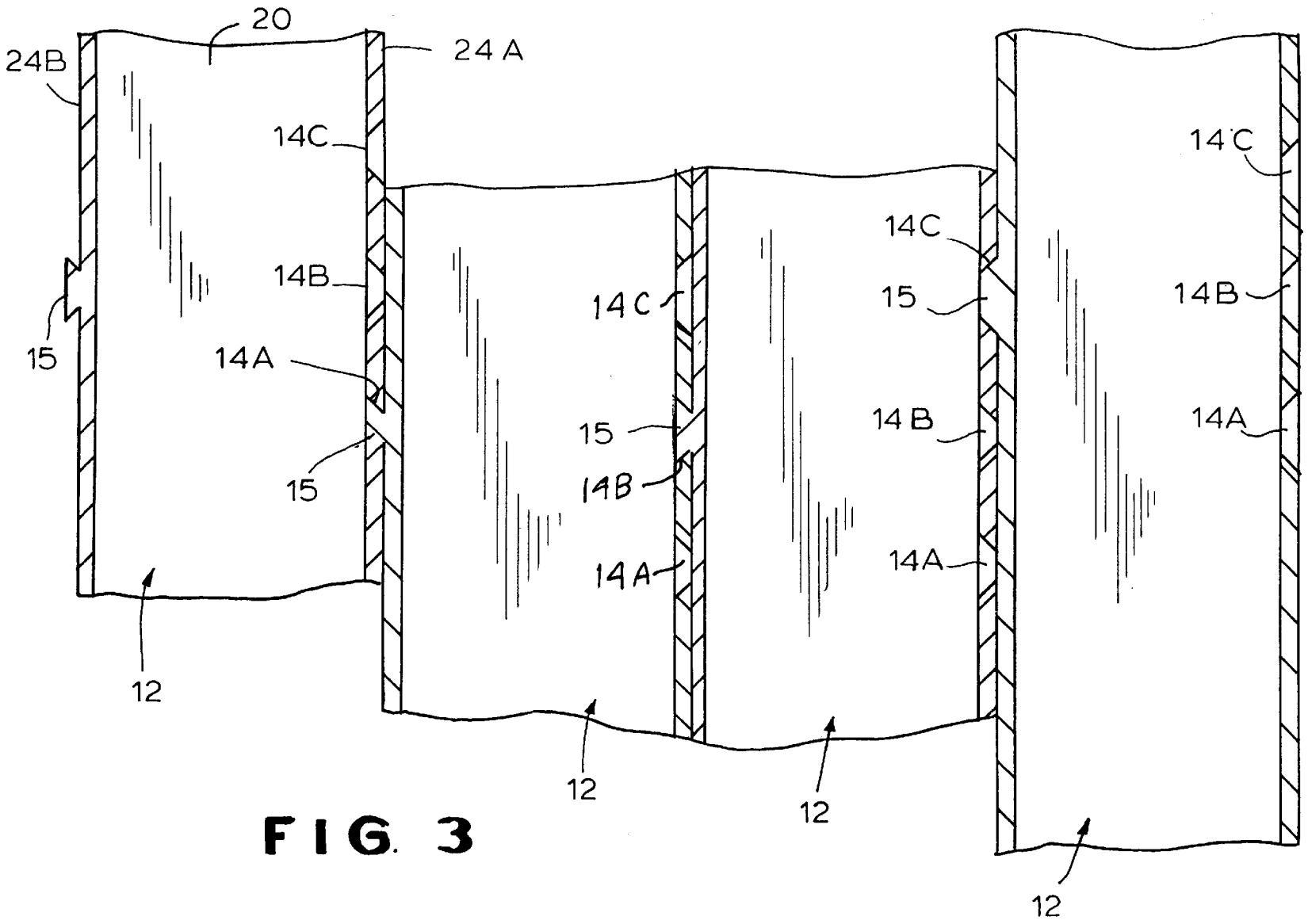
FIG. 3 is a top plan view of a display rack formed of four channels, to a greatly enlarged scale and partially in section.

Thus, referring now to FIG. 3 in particular, the fronts 22 of an adjacent pair of channels 12 are in horizontal alignment when the lugs 15 of one channel are disposed in a middle slot 14B of each associated slot set 30 of the other channel, as shown in the middle two channels of FIG. 3. On the other hand, the fronts of the adjacent pair of channels 12 are in a horizontally stepped non-alignment when the lugs 15 of one channel are disposed in a respective end slot 14A or 14C of each associated slot set 30 of the other channel, as shown in the two outer channels of FIG. 3. More particularly, three or more channel fronts 22 in combination define a stepped convex curve when the lugs 15 are disposed in respective rear end slots 14C of each associated slot set 30 or a stepped concave curve when the lugs 15 are disposed in respective front end slots 14A of each associated slot set 30.

While the present invention has been shown and described with each set 30 having only three narrowly longitudinally spaced apart slots 14A, 14B and 14C, clearly the principles of the present invention are equally applicable to channels wherein each set 30 has more than three narrowly longitudinally spaced apart slots 14. Similarly, while the present invention has been shown and described in terms of channels 12 having a pair of widely longitudinally spaced apart lugs 15 on one channel side wall and a pair of associated slots sets 30 widely longitudinally spaced apart on the other channel sidewall 24, clearly a greater number of lugs 15 and a greater number of slot sets 30 may be used—for example, where the channels 12 are of unusually long length and require additional joining support along their length.

To secure two channels 12 together, they are placed in side-by-side, longitudinally parallel disposition, but with the lugs 15 and selected slots 14 vertically aligned, but vertically displaced. The two channels 12 are then moved into a common horizontal plane so that the lugs 15 are maintained by the selected slots 14 until there is another vertical displacement of the channels 12.

Further details of the lug/slot dovetail arrangement and the method of assembling the same are conventional in nature and need not be described herein in further detail, although the association of a set 30 of slots 14 with each single lug 15 is novel.

The principles of the present invention are equally applicable to display racks which are gravity-fed and those which are not gravity-fed.

To summarize, the present invention provides a display rack formed by adjacent channels having engaging means for releasably retaining an adjacent channel in a side-by-side, longitudinally parallel relationship in a horizontal plane with the channel fronts in horizontal alignment or non-alignment, as decided by the retailer. Such a display rack can utilize more of the available space on store shelves or tray supports having a non-linear (i.e., curvilinear) fronts because the rack is assembled from separate and distinct channels with the assembled channel fronts defining a curvilinear front formed as either a stepped convex or concave curve.

Now that preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A display rack comprising:

a plurality of separate and distinct longitudinally/elongate channels disposed longitudinally parallel to each other in a common horizontal plane, each said channel having:

(A) a front, a track and a pair of laterally spaced, longitudinally extending sides;

(B) a plurality of widely longitudinally spaced apart male engaging means projecting laterally outwardly from one of said channel sides; and (C) for each one of said male engaging means, an associated set of at least three relatively narrowly longitudinally spaced apart female engaging means defined by the other of said channel sides, said associated sets being widely longitudinally spaced apart, and each female engaging means of said associated sets being configured and dimensioned to receive one of said male engaging means;

said male engaging means and female engaging means being configured and dimensioned to releasably retain an adjacent pair of said channels in a side-by-side longitudinally parallel relationship, with said fronts of said adjacent pair of said channels in horizontal alignment or horizontal non-alignment depending on which female engaging means of said associated sets said male engaging means are disposed in.

2. The rack of claim 1 wherein said fronts of said adjacent pair of said channels are in horizontal alignment when said male engaging means are disposed in a middle female engaging means of each associated set.

3. The rack of claim 1 wherein said fronts of said adjacent pair of said channels are in horizontally stepped non-alignment when said male engaging means are disposed in a respective end female engaging means of each associated set.

4. The rack of claim 3 wherein said channel fronts in combination define a stepped convex curve when said male engaging means are disposed in respective rear end female engaging means of each associated set.

5. The rack of claim 3 wherein said channel fronts in combination define a stepped concave curve when said male engaging means are disposed in respective front end female engaging means of each associated set.

6. The rack of claim 1 wherein each set of female engaging means has only three narrowly longitudinally spaced apart female engaging means.

7. The rack of claim 1 wherein each of said male engaging means is a lug, and each of said female engaging means is a slot.

8. A display rack comprising:

a plurality of separate and distinct longitudinally elongate channels disposed in a common horizontal plane, each said channel having:

A. a front, a track, and a pair of laterally spaced, longitudinally extending sides;

B. a plurality of widely longitudinally spaced apart male lugs projecting laterally outwardly from one of said channel sides; and C. for each one of said lugs, an associated set of at least three relatively narrowly longitudinally spaced apart female slots defined by the other of said channel sides, said associated sets being widely longitudinally spaced apart, and each slot of said associated sets being configured and dimensioned to receive one of said lugs;

said lugs and slots being configured and dimensioned to releasably retain an adjacent pair of said channels in a side-by-side longitudinally parallel relationship with said fronts of said pair of said channels in horizontal alignment or horizontal non-alignment depending on which slots of said associated sets said lugs are disposed in, said fronts of said adjacent pair of said channels being in horizontal alignment when said lugs are disposed in a middle slot of each associated set, and said fronts of said adjacent pair of said channels being in a horizontally stepped non-alignment when said lugs are disposed in a respective end slot of each associated set, said tray fronts in combination defining a stepped curve when said lugs are disposed in respective end slots of each associated set.

* * * * *